US007841922B2

(12) United States Patent
Discoe et al.

(10) Patent No.: US 7,841,922 B2
(45) Date of Patent: Nov. 30, 2010

(54) TOY WITH AN ELECTRICAL GENERATOR

(76) Inventors: Justin Miles Discoe, 3455 N. Shields St., Fort Collins, CO (US) 80521; David Scott Bowen, 315 E. Mountain St., #A, Fort Collins, CO (US) 80524; Christopher Jon Clemmer, 2208 Bowside Dr., Fort Collins, CO (US) 80524

( * ) Notice: Subject to any disclaimer, the term of this patent is extended or adjusted under 35 U.S.C. 154(b) by 0 days.

(21) Appl. No.: 12/347,748

(22) Filed: Dec. 31, 2008

(65) Prior Publication Data

US 2009/0227179 A1 Sep. 10, 2009

Related U.S. Application Data

(63) Continuation of application No. PCT/US2008/079432, filed on Oct. 9, 2008.

(60) Provisional application No. 60/978,624, filed on Oct. 9, 2007.

(51) Int. Cl.
*A63H 17/26* (2006.01)
*A63H 17/00* (2006.01)

(52) U.S. Cl. ..... 446/465; 446/469; 446/470; 446/484

(58) Field of Classification Search ..... 446/409, 446/438–441, 462, 465, 466, 484, 469–471; 290/1 R; 310/15, 20
See application file for complete search history.

(56) References Cited

U.S. PATENT DOCUMENTS

| | | | | | |
|---|---|---|---|---|---|
| 3,698,129 | A | * | 10/1972 | Lemelson | 446/462 |
| 3,955,429 | A | * | 5/1976 | Holden | 74/64 |
| 4,193,223 | A | * | 3/1980 | D'Andrade et al. | 446/438 |
| 5,432,382 | A | * | 7/1995 | Pawlowski | 290/1 R |
| 6,361,393 | B1 | * | 3/2002 | Seymour | 446/34 |

* cited by examiner

*Primary Examiner*—Kien T Nguyen
(74) *Attorney, Agent, or Firm*—Dergosits & Noah LLP

(57) ABSTRACT

The invention is directed to a toy comprised of a vehicle that is capable of generating electrical energy and a body that can be physically and electrically connected to and disconnected from the vehicle. In one embodiment, the body comprises a light and a capacitor that stores electrical energy produced by the generator when the body is connected to the vehicle and the vehicle is used to produced electrical energy. After separation of the body from the vehicle, the capacitor provides electrical energy to the light that allows a child to separately use the body as a torch or flashlight. In another embodiment, the vehicle includes a speaker and the body includes a memory device that stores a signal that can be played over the speaker when the body is connected to the vehicle. In yet a further embodiment, a toy vehicle is provided in which an electrical generator uses the kinetic energy produced by the reciprocating motion of at least one wheel of the vehicle about an axis that is spaced from the wheel to produce electrical energy that can be used to drive an electrical device.

20 Claims, 9 Drawing Sheets

TOY WITH AN ELECTRICAL GENERATOR

CROSS-REFERENCE TO RELATED APPLICATIONS

This application claims the priority benefit of U.S. Provisional Patent Application No. 60/978,624, entitled "USER POWERED ELECTRONIC AMUSEMENT DEVICE," filed on Oct. 9, 2007, the entire disclosure of which is incorporated herein by reference.

FIELD OF THE INVENTION

The present invention relates to a toy and, more specifically, to a toy that includes an electrical generator for producing electrical energy that can be used to drive an electrical device associated with the toy.

BACKGROUND OF THE INVENTION

Presently, toys are known that incorporate an electrical generator to produce electrical current that is, in turn, applied to a light or other device that is part of the toy. An example of such a toy is disclosed in U.S. Pat. No. 4,193,223.

SUMMARY OF THE INVENTION

The present invention is directed to a toy comprised of a vehicle that is capable of providing electrical energy and a body that includes an electrical device that can use the electrical energy that the vehicle is capable of providing. In one embodiment, the body can be physically and electrically connected to and disconnect from the vehicle. When the body is connected to the vehicle, electrical energy can be provided from the vehicle to an electrical device associated with the body. Since the body can be connected to and disconnected from the vehicle, it is possible to swap one body for another body. Further, the bodies can each incorporate a different electrical device. For instance, one body can employ a light and another body can employ speaker. In one embodiment, a number of bodies can be employed with each body representing a different "adventure guide" and including a memory device that holds a different "adventure story or theme" that can be played on a speaker associated with the toy.

In one embodiment, the body comprises a light and a capacitor. When the body is connected to the vehicle and receiving sufficient electrical energy from the vehicle, the light is activated and the capacitor is charged. When the body is subsequently disconnected from the vehicle, the stored charge on the capacitor is provided to the light. The light will remain active for as long as the capacitor is able to provide sufficient current. As such, the body serves as a temporary torch or flashlight.

In another embodiment, the electrical energy that is provided by the vehicle is produced by an electrical generator, thereby avoiding the use of batteries. The electrical generator converts kinetic energy that is produced when at least one of the wheels associated with the vehicle is moved into electrical energy. The electrical energy, in turn, being provided to an electrical device associated with a body and/or to other electrical devices associated with the toy. In one embodiment, a linkage is employed to transmit kinetic energy resulting from reciprocating rotational movement of a wheel of the vehicle about an axis that is spaced or separated from the wheel. This is in contrast to kinetic energy that is produced by rotation of a wheel about the rotational axis of the wheel.

DETAILED DESCRIPTION

Figure 1A:
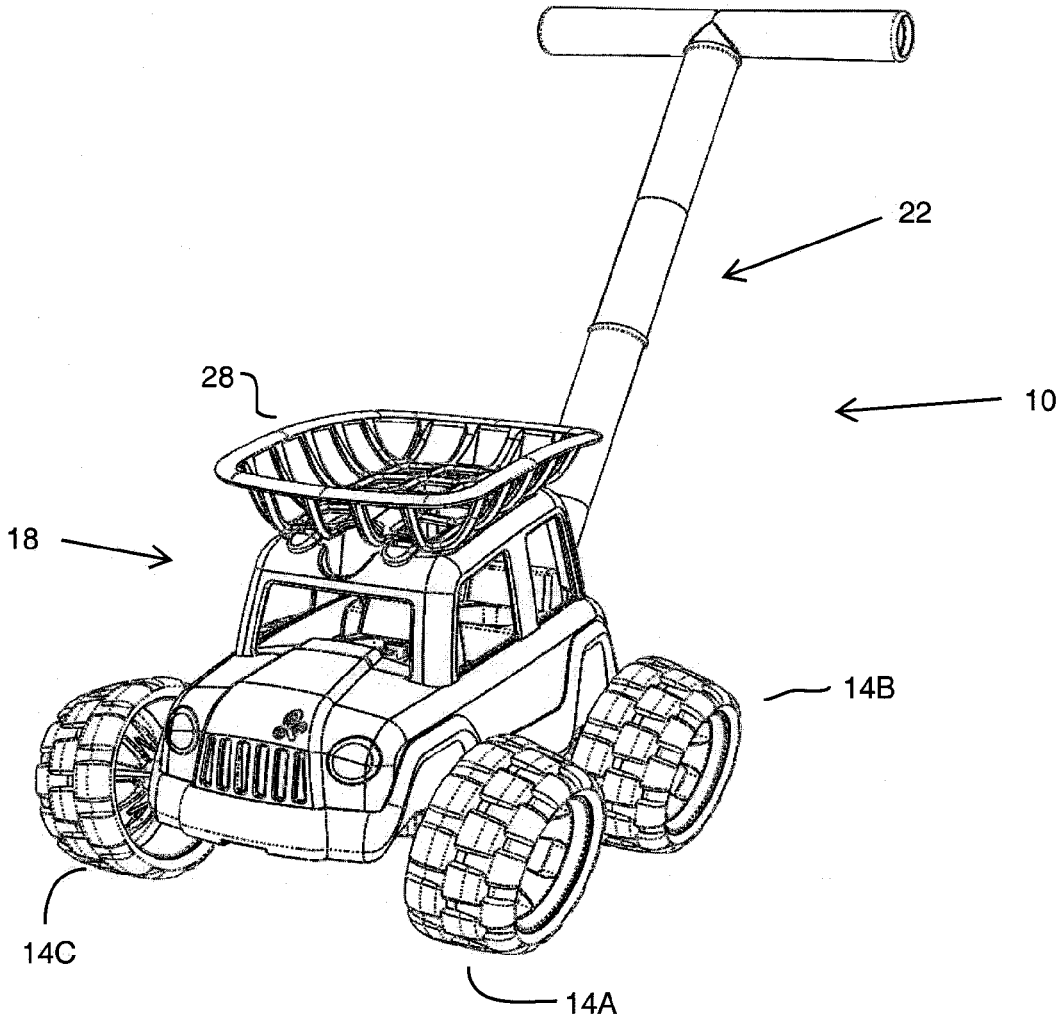
FIG. 1A illustrates a first embodiment of a toy vehicle in accordance with the present invention.
Figure 1B:
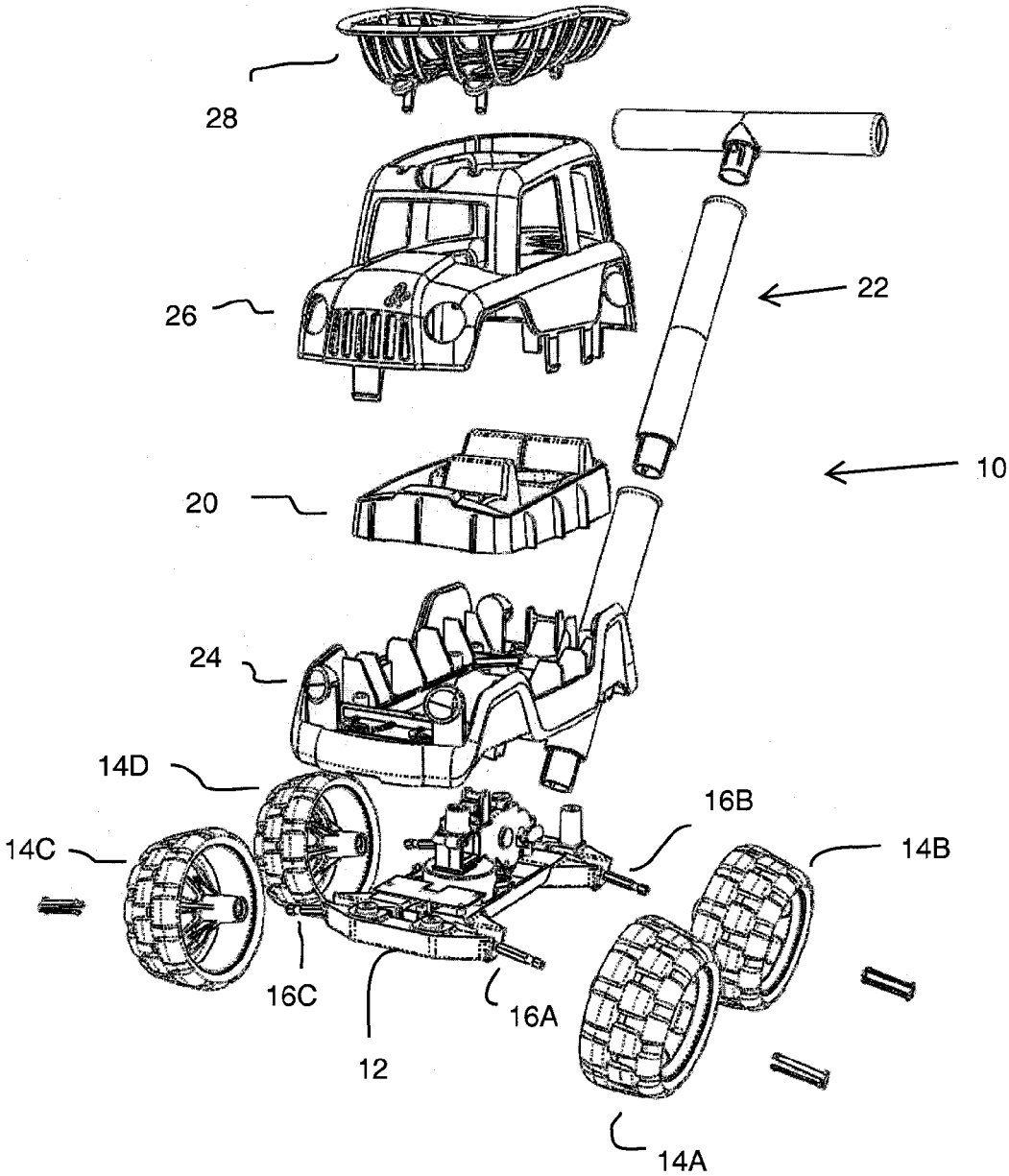
FIG. 1B is an exploded view of the toy vehicle illustrated in FIG. 1A.
Figure 1C:
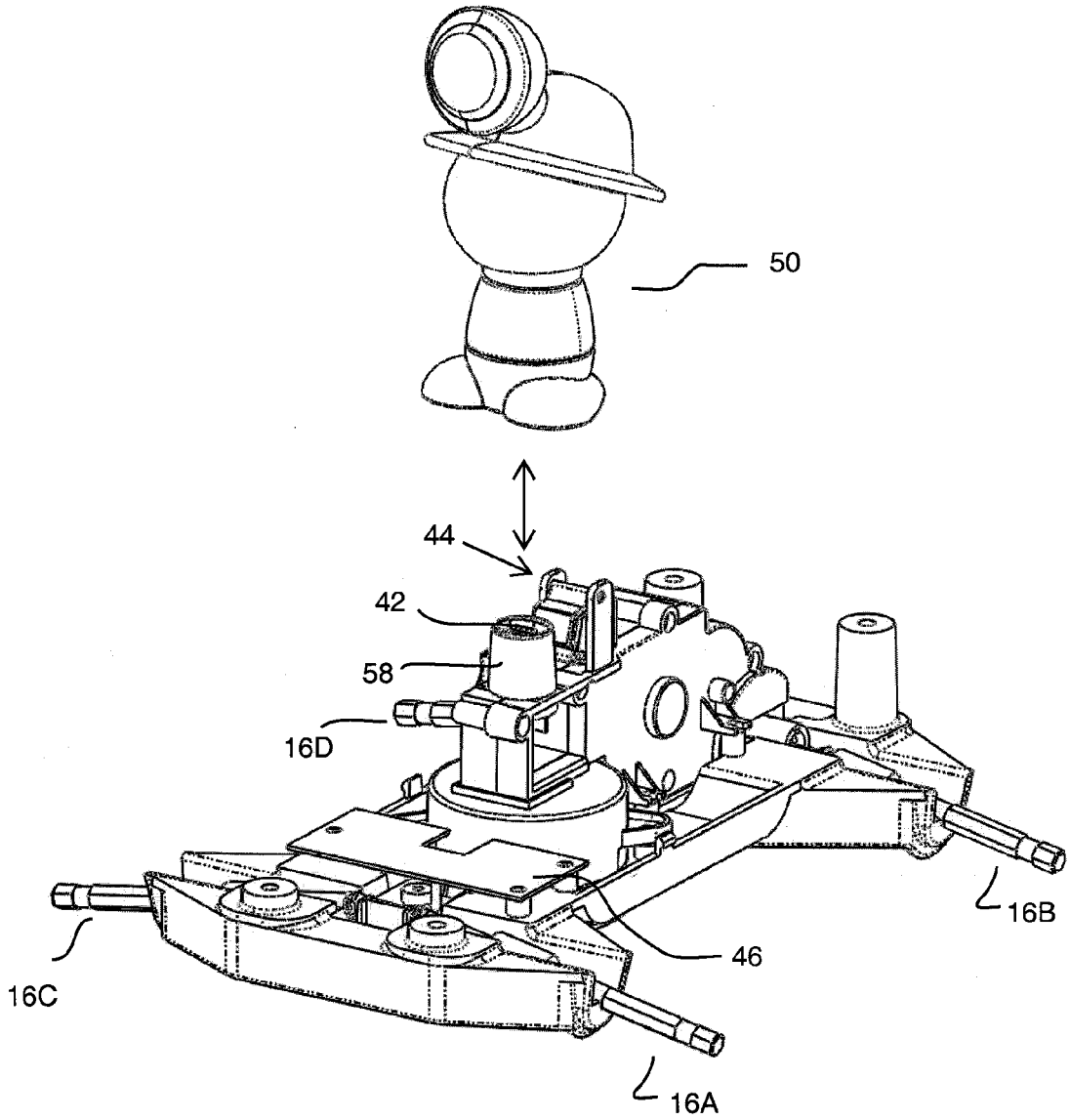
FIG. 1C illustrates the frame, electrical generator, and other electrical components associated with the toy vehicle illustrated in FIG. 1A and a body (toy character) that can be physically and electrically attached to and detached from the toy vehicle.

FIGS. 1A-1D illustrate an embodiment of a toy vehicle, hereinafter vehicle 10, that is capable of providing electrical energy to a body that can be physically and electrically attached to and detached from the toy vehicle. FIGS. 1C, 2A, and 2B illustrate an embodiment of such a body. The vehicle 10 is comprised of a frame 12, a set of four wheels 14A-14D, four axles 16A-16D that are respectively used to attach the wheels 14A-14D to the frame 12, a vehicle exterior 18 that is attached to the frame 12, a vehicle interior 20 that is attached to the frame 12, and a handle 22 that can be attached to and detached from the frame 12 as needed. The vehicle exterior 18 is comprised of a lower section 24, an upper section 26, and a detachable luggage rack 28. The vehicle interior 20 is situated between the lower section 24 and upper section 26 of the exterior 18.

Figure 1D:
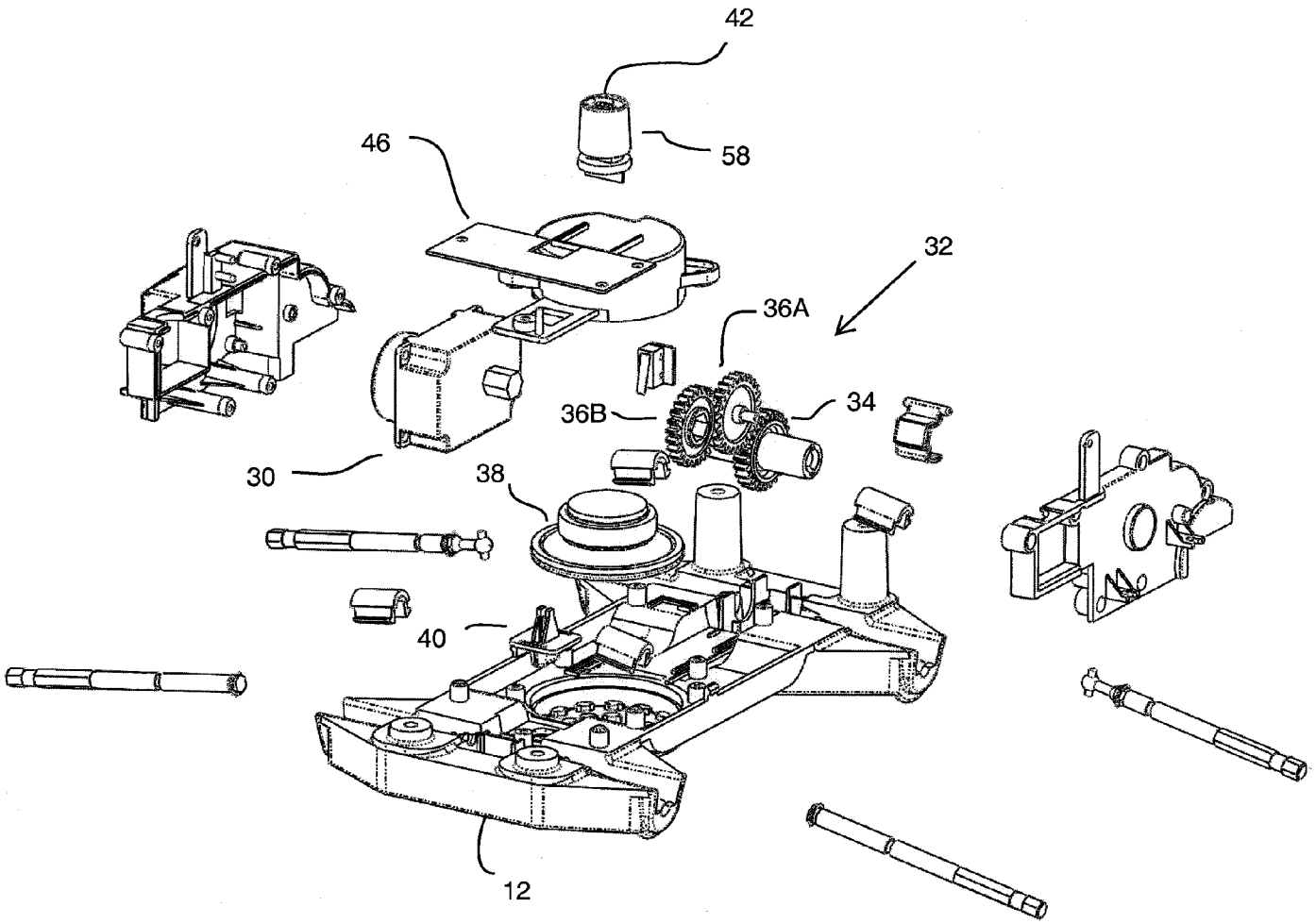
FIG. 1D is an exploded view of the components of the toy vehicle illustrated in FIG. 1C.
Figure 2A:
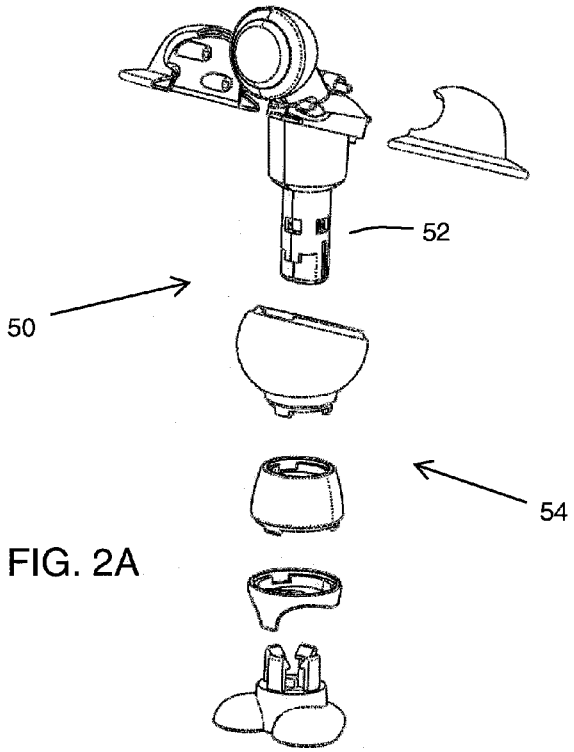
FIG. 2A is an exploded view of the body illustrated in FIG. 1C.
Figure 2B:
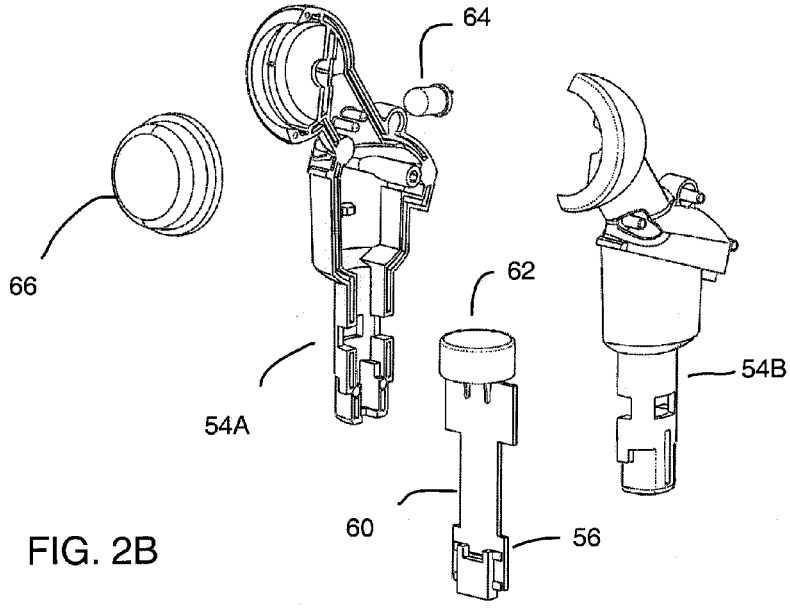
FIG. 2B illustrates the electrical and electronic componentry associated with the body illustrated in FIG. 1C.

With reference to FIGS. 1C and 1D, the vehicle 10 is further comprised of an electrical generator 30, a linkage 32 for transmitting kinetic energy generated by rotation of the wheels 14B, 14D to the electrical generator 30, and other electrical/electronic components associated with the use of the electrical energy produced by the generator. The electrical generator 30, a substantial portion of the linkage 32, and most of the other electrical/electronic components are substantially hidden from the view of a child playing with the toy by the frame 12, vehicle exterior 18, and vehicle interior 20. The electrical generator 30 is a three-phase generator that utilizes a flywheel. The linkage 32 is comprised of the axles 16B, 16D, an axle gear 34 that engages the axles 16B, 16D, and two transmission gears 36A, 36B that convey rotational energy produced by the axle gear 34 to the generator 30. In operation, when a child or other individual causes the wheels 14B, 14D to rotate (typically by pushing the vehicle 10 along a floor), kinetic energy produced by the rotation of the wheels is transmitted by the axles 16B, 16D to the axle gear 34, causing the axle gear 34 to rotate. The rotational energy of the rotating axle gear 34 is, in turn, conveyed to the generator 30 by the operation of the transmission gears 36A, 36B. In response, the generator 30 produces three-phase electrical current.

Having described the use of the generator 30 to produce electrical energy, the application of that electrical energy is now described. Generally, electrical energy produced by the electrical generator 30 is used within the vehicle 10 and can be used with a body that can by physically and electrically attached to and detached from the vehicle 10. With continuing reference to FIGS. 1C and 1D, among the electrical/electronic components that are associated with the use of the electrical energy produced by the electrical generator 30 and associated with the vehicle 10 are a speaker 38, a mode selection switch 40, a first portion of a connector 42, and a CPU selection switch 44. The mode selection switch 40 and other electrical/electronic components associated with the vehicle 10 are situated of a printed circuit board 46.

With reference to FIGS. 2A and 2B, electrical energy produced by the generator 30 can also be applied to a body 50 that can by physically and electrically attached to and detached from the vehicle 10, as illustrated in FIG. 1C. When the body 50 is attached to the vehicle 10, the body appears to be located in a front seat of the interior 20. The body 50 is comprised of a housing 52 for holding electrical/electronic components and a skin 54 that covers the housing 52 so as to make the body 50 appear as "character" or doll. In the illustrated embodiment, the body 50 is an "adventure guide." It should be appreciated that any number of different skins can be employed to create different dolls that each have different characteristics. Alternatively, a body without a "skin" is also feasible. The housing 52, in the illustrated embodiment, is a two-piece plastic housing having a first portion 54A and a second portion 54B. The housing 52 substantially encloses and supports a second portion of a connector 56 that is capable of engaging the first portion of a connector 42 associated with the vehicle 10 so that electrical energy can be conveyed between the body 50 and the vehicle 10. The second portion of the connector 56 is also capable of being disengaged from the first portion of the connector 42. In the illustrated embodiment, the first and second portions 42, 56 of the connector form a USB connector. It should, however, be appreciated that other types of connectors are possible depending upon the type of electrical energy and/or signals that are to be conveyed between the vehicle 10 and the body 50. The bottom portion of the housing 52 fits inside a well defined by a support structure 58 that holds the first portion 42 of the USB connector to support the body 50 in an upright position. In essence, the body 50 can be plugged into and unplugged from the vehicle 10. Other structures for allowing the body 50 to be plugged and unplugged from the vehicle are feasible. The housing 52 also encloses a printed circuit board 60 that supports other electrical/electronic circuitry, a capacitor 62, and an LED 64 that is connected to the capacitor 60 by wires (not shown). Additionally, the housing supports a lens structure 66 that protects the LED 64 and passes the light produced b the LED 64.

Figure 3:
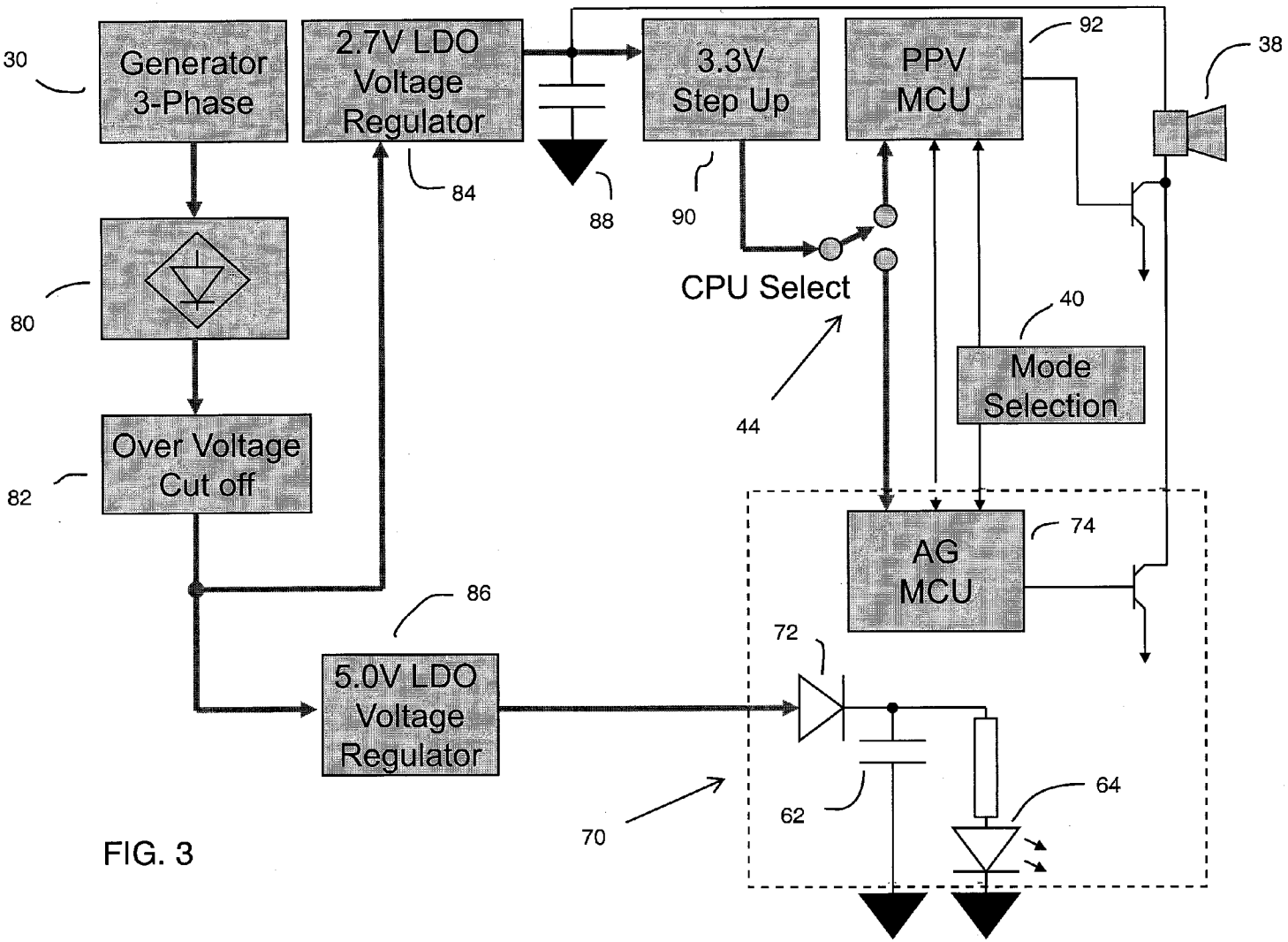
FIG. 3 is a block diagram to the electrical circuitry employed in the toy vehicle illustrated in FIG. 1A and the body illustrated in FIG. 1C.

With reference to FIG. 3, the electrical/electronic components associated with the vehicle 10 and with the body 50 are further described. The electrical/electronic components associated with the body 50 are located within box 70 and include the capacitor 62 and the LED 64. Also associated with the body 50 are a diode 72 and a body microcontroller 74. The components associated with the vehicle 10 are located outside of the box 70 and include the electrical generator 30, speaker 38, mode selection switch 40, and CPU selection switch 44. Also associated with the vehicle 10 are a rectifier 80, over-voltage cutoff circuit 82, 2.7V low dropout regulator 84, a 5.0V low dropout regulator 86, a capacitor 88, a 3.3 V step up 90, and a vehicle microcontroller 92.

With continuing reference to FIG. 3, the circuitry operates so that electrical energy produced by the generator 30 is applied to one of the body microcontroller 74 and the vehicle microcontroller 92 depending on the state of the CPU select switch 44. Generally, the state of the CPU select switch 44 depends on whether the body 50 is physically and electrically connected to the vehicle 10. To elaborate, if the body 50 is so connected, a portion of the body 50 contacts the switch 44 such that the switch 44 will direct any electrical energy reaching the switch 44 to be applied to the body microcontroller 74 and not the vehicle microcontroller 92. If the body 50 is not actuating the switch 44, the switch 44 operates such that any electrical energy reaching the switch is applied to the vehicle microcontroller 92. The body 50 may not be actuate the switch 44 if the body 50 has not been completely "plugged in" to the vehicle 10. Alternatively, a body can be employed that does not embody a microcontroller and that employs a skin that is purposely shaped so as not to actuate the switch 44 in the course of being plugged-in. While such a "dummy" body (i.e., a body without a processor) may employ the LED 64 and related circuitry, it can also employ only an LED or other lighting device. Further, such a "dummy" body can also employ one or more other non-processor, electrical/electronic components instead of the LED and related circuitry or no electrical/electronic circuitry at all.

Regardless of whether the switch 44 is directing electrical energy reaching the switch to the body microcontroller 74 or the vehicle microcontroller 92, the state of the mode selection switch 40 determines the manner in which the selected microcontroller performs. To elaborate, the mode selection switch 40 can be placed in one of three possible states by the user. In the first state, the selected microcontroller is disabled, which in the described embodiment will result in no programs being played that would cause a signal to be applied to the speaker 38. Placing the switch 40 is in the second state or third state will cause one of two programs present in the selected microcontroller's memory to be selected and, assuming the selected microcontroller is receiving sufficient electrical energy, played. In the illustrated embodiment, the playing of a program causes a signal to be applied to the speaker 38 to produce a sound. For instance, one program may contain data such that when the program is played, a signal is applied to the speaker 38 that produces a sound reminiscent of an engine revving. Alternatively, the playing of a program may cause a signal to be applied to the speaker 38 such that a "story line" for playing with the toy is conveyed to a child. For example, the story line may be that of an Amazon adventure. It should be appreciated that a mode selection switch that only has two selectable states or more than three selectable states is feasible. Further, it should also be appreciated that regardless of the state of the switch 40, the selected microcontroller may or may not have a program that corresponds to the particular state of the switch 40.

Generally, the capacitor 88 is used to store electrical energy when the generator 30 is producing electrical energy and then provide this stored energy to the selected microcontroller when the generator 30 is not producing any electrical energy. As such, the capacitor 88 allows the selected microcontroller to continue to function for a limited amount of time after a child has ceased whatever activity was causing the wheels 14B, 14D to turn and the electrical generator 30 to produce electrical energy. The length of time that the capacitor 88 can provide sufficient electrical energy for the selected microcontroller to operate depends on the size of the capacitor. In the illustrated embodiment, a large capacitor is utilized that is capable of providing sufficient electrical energy to the selected microcontroller for more than a minute. The step up circuit 90 processes the 2.7V signal received from the capacitor 88 to produce a 3.3V signal, which is sufficient for powering either of the two microcontrollers.

To protect the capacitor 88, two measures are taken. The regulator 84 prevents the voltage applied to the capacitor 88 from exceeding 2.7 volts. Further, it is possible, although considered remote, that the generator 30 can produce a voltage that can exceed the capabilities of the regulator 84. To address this possibility, the over-voltage cut off circuit 82 operates to prevent any of the electrical energy being produced by the generator 30 from reaching the capacitor 88 and other circuitry when the voltage associated with the electrical energy being produced by the generator 30 exceeds the capabilities of the regulator 84. The rectifier 80 serves to rectify the three phase alternating current produced by the generator 30.

The voltage regulator 86 regulates the voltage applied to the capacitor 62, LED 64, diode 72 circuit associated with the body 50 when the body is operatively attached to the vehicle 10. The over-voltage cut off circuit 82 also protects the regulator 86 in the situation in which the generator 30 is generating electrical energy with a voltage that would exceed the capabilities of the regulator 50 and potentially damage one or more of the capacitor 62, LED 64, and diode 72 associated with the body.

Generally, the capacitor 62 is used to store electrical energy when the generator 30 is producing electrical energy and the body 50 is operatively connected to the vehicle 10. After the body 50 is electrically disconnected from the vehicle 10, the energy stored in the capacitor 62 is provided to the LED 64. As such, the body 50 can act as a torch or flashlight after the body 50 is disconnected from the vehicle for however long the capacitor 62 is able to provide sufficient current to the LED 64. The diode 72 serves to prevent charge stored on the capacitor 62 from flowing back to the regulator 86 when the body 50 is electrically connected to the vehicle 10. The capacitor 62 also provides stored electrical energy to the LED 64 when the body is still connected to the vehicle but the generator 30 is not producing electrical energy.

Figure 4A:
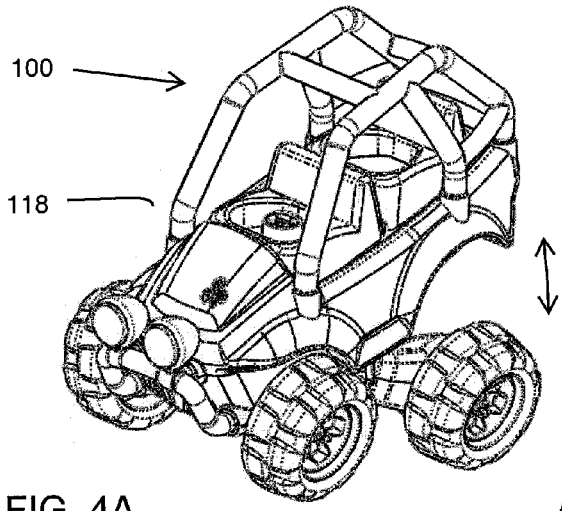
FIG. 4A illustrates a second embodiment of a toy vehicle in accordance with the present invention.
Figure 4B:
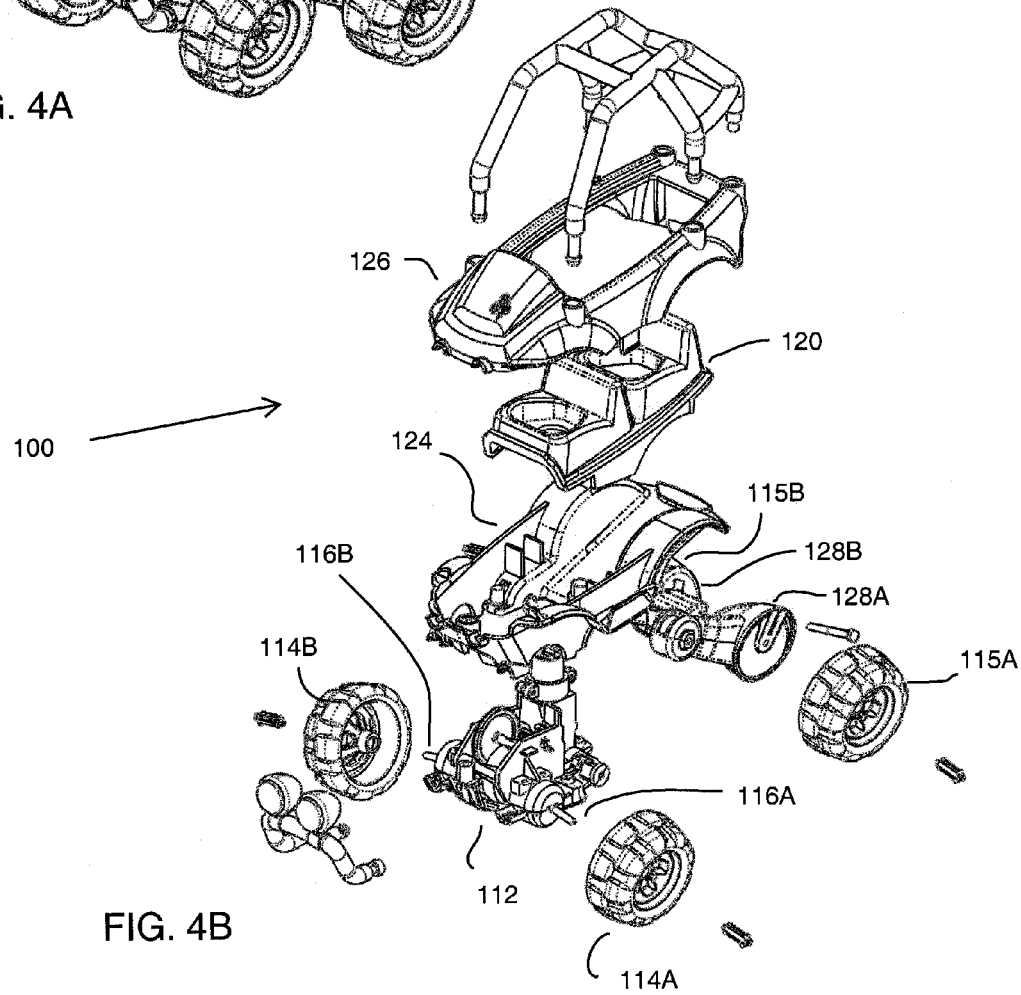
FIG. 4B is an exploded view of the toy vehicle illustrated in FIG. 4A.
Figure 4C:
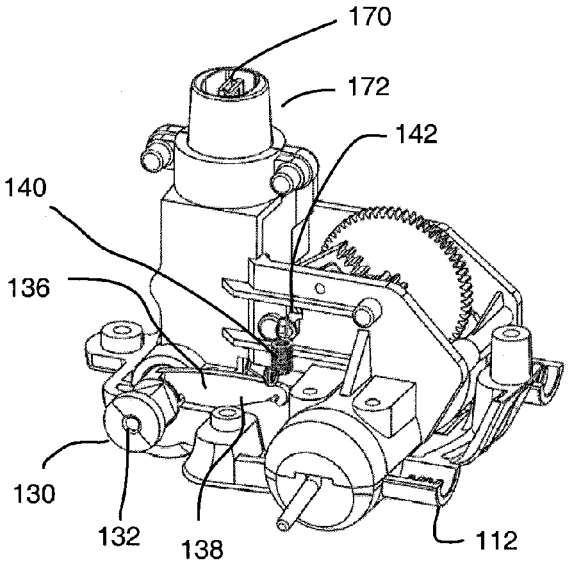
FIG. 4C-4F illustrate an embodiment of a mechanism that is associated with the embodiment of the toy vehicle illustrated in FIG. 4A and used to convert kinetic energy produced as a result of reciprocating rotational motion through a limited angular extent into electrical energy.
Figure 4D:
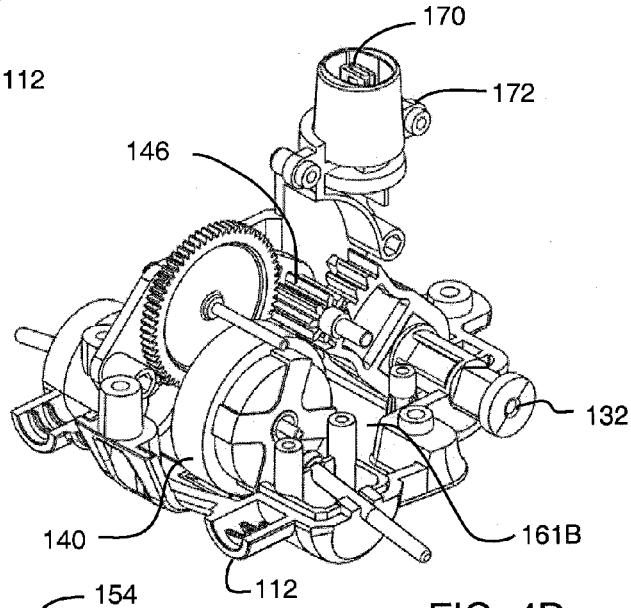
Figure 4E:
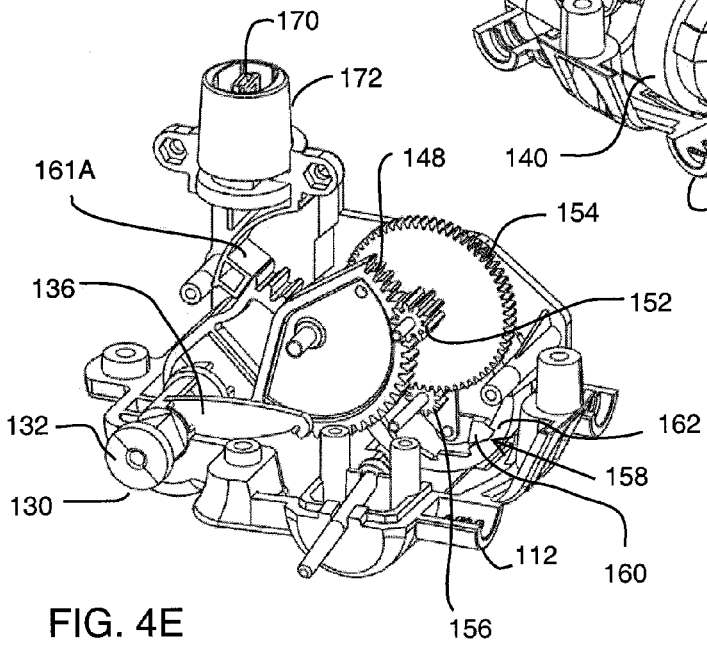
Figure 4F:
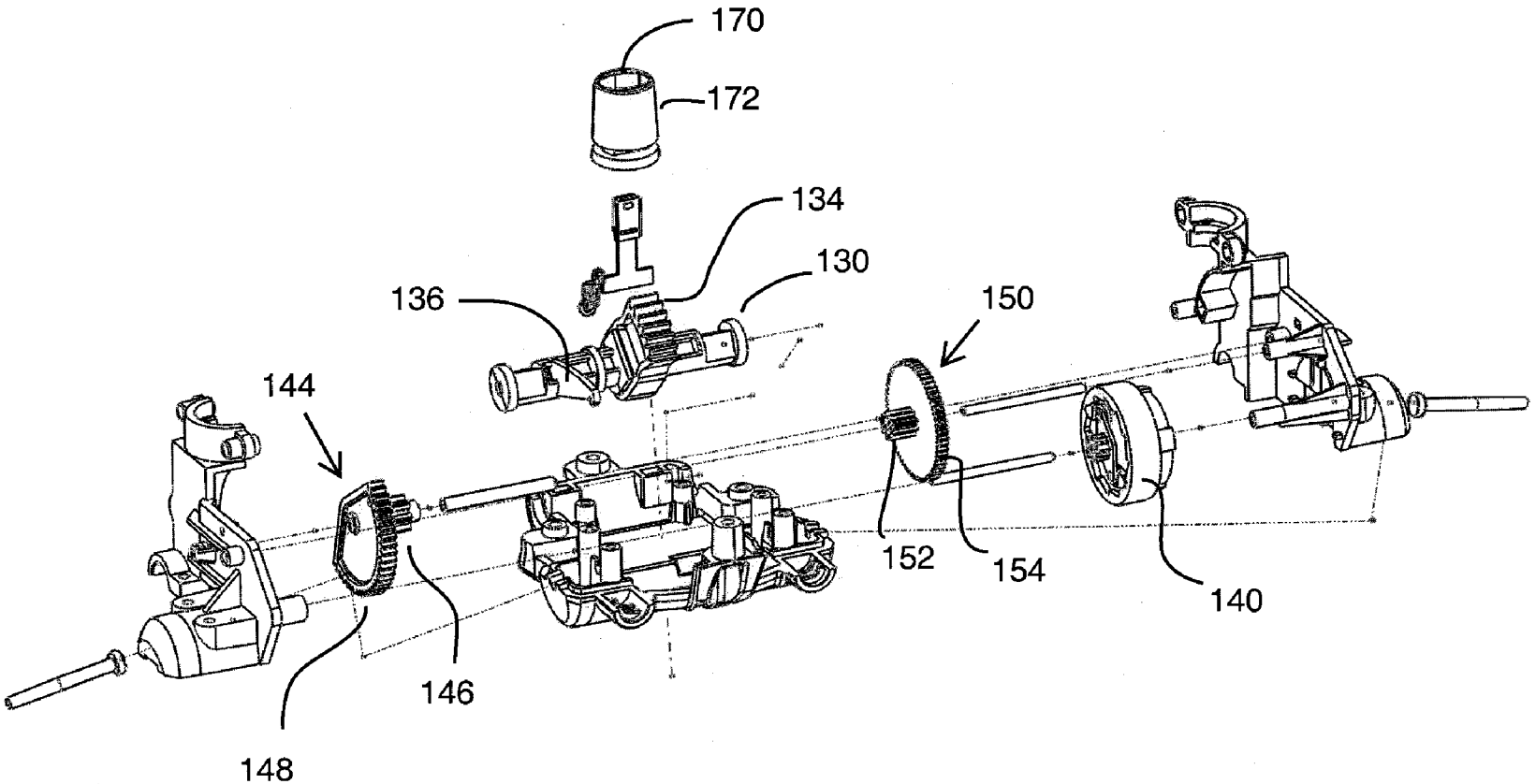

FIGS. 4A and 4B illustrate a second embodiment of a toy vehicle, hereinafter vehicle 100, that is capable of providing electrical energy to a body that can be physically and electrically attached to and detached from the toy vehicle. In contrast to vehicle 10, the kinetic energy that is converted into electrical energy is generated through the reciprocating rotational motion of a wheel about an axis of rotation that is separated from the axis of rotation of the wheel.

The vehicle 10 is comprised of a frame 112, two front wheels 114A-114B, two rear wheels 115A, 115B, two axles 116A, 116B that are respectively used to attach the wheels 114A, 114B to the frame 112, a vehicle exterior 118 that is attached to the frame 112, and a vehicle interior 120 that is attached to the frame 112. The vehicle exterior 118 is comprised of a lower section 124 and an upper section 126. The vehicle interior 120 is situated between the lower section 124 and upper section 126 of the exterior 118.

The rear wheels 115A, 114B are respectively connected to swing arms 128A, 128B, with each wheel capable of rotating about the wheel's rotational axis. With reference to FIGS. 4C-4F, the swing arms 128A, 128B are each attached to a shaft 132. The shaft 132 is connected to frame 112 but capable of rotation about axis of rotation 132. Also attached to the shaft 132 are a shaft gear 134 and an armature 136 with a free end 138. A spring 140 extends between the free end 138 of the armature 136 and an anchor point 142. In operation, a child pushes down on the rear of the vehicle exterior 118 to cause the rear wheels 115A, 115B to rotate about the axis of rotation 132. Further, this action causes the shaft 132 and the armature 136 to rotate about the axis of rotation 132. The rotation of the armature 136, in turn, causes the spring 140 to become elongated. Once the child ceases applying a downward force to the rear of the vehicle exterior 118, the energy stored in the spring causes the shaft 132, armature 136, swing arms 128A, 128B, and rear wheels 115A, 115B all to rotate about the axis of rotation 132 in the opposite direction such that the vehicle returns to the posture shown in FIG. 4A. This rotation of the rear wheels 115A, 115B about the axis of rotation 132 in one direction and then the other direction can be repeated to produce a reciprocating type of motion. This reciprocating action can be used to generate electrical energy.

The reciprocating movement of the rear wheels 115A, 115B about the axis of rotation 132 produces kinetic energy that is applied to an electrical generator 140 and converted by the generator 140 into electrical energy. To elaborate, rotation of the rear wheels 115A, 115B about the axis of rotation 132 causes the shaft 130 to also rotate about the axis of rotation 132. Kinetic energy associated with the rotation of the shaft 130 is conveyed to the generator 140 by a series of gears. The series of gears includes the shaft gear 134, a first spur gear 144 with a first toothed section 146 and a second toothed section 148, and a second spur gear 150 with a third toothed section 152 and a fourth toothed section 154. The teeth of the shaft gear 134 engage the first toothed section 146 of the first spur gear 144, the second toothed section of the first spur gear 144 engages the third toothed section 152 of the second spur gear 150. The fourth toothed section 154 of the second spur gear engages a gear 156 that is, in turn, attached to a ratchet mechanism 158. The ratchet mechanism 158 operates such that, when the gear 156 rotates in one direction, a pawl 160 engages a rack 162 that is attached to the freewheel of the generator 140 and causes the freewheel to rotate. When the gear 156 rotates in the opposite direction, the pawl 160 does not engage the rack 162 and, as such, no kinetic energy is transferred to the generator 140. The rotation of the shaft 130 is limited to a particular angular extent by stops 161A, 161B, which each engage one side of the shaft gear 134 to prevent further rotation of the shaft 130. In the illustrated embodiment, the angular extent is less than 45°. It should be appreciated that other mechanism for transferring the kinetic energy produced by a rotating shaft, such as shaft 130, to an electrical generator, such as generator 140, can be accomplished by a number of different mechanical transmission mechanisms.

The generator 140 in the illustrated embodiment is a single phase generator that supplies electrical energy to an electrical connector 170 that is housed in a support structure 172 that, like support structure 58, forms a well accommodates the bottom portion of the housing 52 of the body 50. The electrical energy produced by the generator 140 is applied to the body 50 without any intervening voltage regulator. Further, since the vehicle 100 does not employ a speaker, it can be used with a body that does not embody a microcontroller or have a memory with a program.

It should be appreciated that the structure disclosed herein for converting the kinetic energy associated with the reciprocating rotation of a shaft within a limited angular range can be adapted to other types of toys. For instance, the structure can be adapted to a swing set in which the kinetic energy associated with the reciprocating motion of the swing seat within a limited angular range is used to generate electrical energy that can be used to power one or more electrical devices associated with a swing set.

While the invention has been particularly shown and describe with reference to various embodiments hereof, it will be readily understood by those skilled in the art that various changes in the form and details may be made without departing from the spirit and scope of the invention. For example, while integrated circuits, such as microcontrollers have been employed in at least one embodiment, it will be readily understood that discrete components and combinations of discrete components and integrated circuit can also be used.

What is claimed is:

1. A toy comprising:

a toy vehicle comprising:

a vehicle frame;

a set of wheels, each wheel operatively connected to said vehicle frame;

an electrical generator, operatively connected to said vehicle frame, for receiving kinetic energy and converting at least a portion of received kinetic energy into electrical current;

a linkage for transmitting kinetic energy resulting from movement of at least one wheel of said set of wheels to said electrical generator; and a first portion of an electrical connector, wherein said first portion is operatively connected to said frame;

a toy body comprising:

a body frame;

an electrical device operatively attached to said body frame; and a second portion of an electrical connector, wherein said second portion is operatively connected to said body, said second portion capable of engaging said first portion to establish a connection for the conveyance of electrical energy, and said second portion capable of being disengaged from said first portion.

2. A toy, as claimed in claim 1, wherein:

said electrical device comprises a light.

3. A toy, as claimed in claim 1, wherein:

said electrical device comprises a capacitor and a light;

wherein said capacitor is capable of storing electrical energy when said second portion is connected to said first portion and said electrical generator is providing electrical current to said capacitor, and providing stored electrical energy to said light for a substantial period of time after said second portion is disengaged from said first portion.

4. A toy, as claimed in claim 1, further comprising;

a speaker, operatively connected to said frame.

5. A toy, as claimed in claim 4, wherein:

said electrical device comprises a memory device for storing a signal suitable for application to said speaker.

6. A toy, as claimed in claim 5, wherein:

said signal emulating the sound of a vehicle engine.

7. A toy, as claimed in claim 5, wherein:

said signal conveys an adventure play theme when played on said speaker.

8. A toy, as claimed in claim 4, further comprising:

a memory device that is separate from said body and capable of providing a signal to said speaker when said first portion is disengaged from said second portion.

9. A toy, as claimed in claim 1, wherein:

said linkage conveys kinetic energy produced by rotation of said at least one wheel of said set of wheels about an axis of rotation.

10. A toy, as claimed in claim 9, wherein:

said axis of rotation is substantially perpendicular to the plane of said at least one wheel.

11. A toy, as claimed in claim 9, wherein:

said axis of rotation intersects said at least one wheel.

12. A toy, as claimed in claim 9, wherein:

said axis of rotation does not intersect said at least one wheel.

13. A toy, as claimed in claim 1, wherein:

said linkage comprising an arm that has a first end and a second end that is separated from said first end;

wherein said at least one wheel is pivotally attached to said first end of said arm; and wherein said second end is pivotally connected to said frame so that said arm can rotate about a pivot point.

14. A toy, as claimed in claim 13, wherein:

said electrical generator converts kinetic energy produced by rotation of said arm about said pivot point in one direction of rotation and not in the other direction of rotation.

15. A toy comprising:

a vehicle frame;

a set of wheels, each wheel operatively connected to said vehicle frame;

an electrical generator, operatively connected to said vehicle frame, for receiving kinetic energy and converting at least a portion of received kinetic energy into electrical current;

a linkage for transmitting kinetic energy resulting from reciprocating rotational movement of at least one wheel of said set of wheels about an pivot axis that is separated from an axis of rotation of said at least one wheel;

a first portion of an electrical connector, wherein said first portion is operatively connected to said frame, capable of engaging a second portion of an electrical connector to establish a connection for the conveyance of electrical energy, and said second portion capable of being disengaged from said first portion.

16. A toy, as claimed in claim 15, wherein:

said linkage comprises an arm having a first end and a second end that is separated from said first end;

wherein said at least one wheel is pivotally attached to said first end of said arm and is capable of rotating about a first pivot axis;

wherein said second end of said arm is pivotally connected to said frame and is capable of rotating about a second pivot axis that is different than said first pivot axis.

17. A toy, as claimed in claim 15, wherein:

said linkage comprising a first stop and a second stop that limit the rotation of said arm about said second pivot axis to less than 360°.

18. A toy, as claimed in claim 17, wherein:

said first and second stops limit the rotation of said arm about said second pivot axis to less than about 90°.

19. A toy, as claimed in claim 15, wherein:

said electrical generator converts kinetic energy produced by rotation of said arm about said second pivot axis in one direction of rotation and not in the other direction of rotation.

20. A toy, as claimed in claim 15, further comprising:

a body comprising:

a body frame;

an electrical device operatively attached to said body frame; and a second portion of said electrical connector, wherein said second portion is operatively connected to said body, said second portion capable of engaging said first portion to establish a connection for the conveyance of electrical energy, and said second portion capable of being disengaged from said first portion.

* * * * *